US011155088B2

(12) United States Patent
Kakamu et al.

(10) Patent No.: US 11,155,088 B2
(45) Date of Patent: Oct. 26, 2021

(54) LIQUID EJECTION HEAD

(71) Applicant: BROTHER KOGYO KABUSHIKI KAISHA, Nagoya (JP)

(72) Inventors: Katsumi Kakamu, Kuwana (JP); Masaaki Deguchi, Chiryu (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/527,161

(22) Filed: Jul. 31, 2019

(65) Prior Publication Data

US 2020/0039224 A1 Feb. 6, 2020

(30) Foreign Application Priority Data

Aug. 6, 2018 (JP) ..... JP2018-147608

(51) Int. Cl.
*B41J 2/14* (2006.01)
*B41J 2/055* (2006.01)

(52) U.S. Cl.
CPC ..... *B41J 2/14233* (2013.01); *B41J 2/055* (2013.01); *B41J 2002/14241* (2013.01); *B41J 2002/14419* (2013.01); *B41J 2002/14491* (2013.01)

(58) Field of Classification Search
CPC ..... B41J 2/14145; B41J 2002/14306; B41J 2002/14419; B41J 2002/14467; B41J 2002/14459; B41J 2202/12
See application file for complete search history.

(56) References Cited

U.S. PATENT DOCUMENTS

2008/0143793 A1* 6/2008 Okuda ..... B41J 2/14233 347/68
2012/0182354 A1* 7/2012 Akahane ..... B41J 2/045 347/54
2020/0031124 A1 1/2020 Kawamura et al.
2021/0008885 A1 1/2021 Kaneko et al.

FOREIGN PATENT DOCUMENTS

JP 2013-067178 A 4/2013
JP 2016-030367 A 3/2016
JP 2017-113932 A 6/2017

* cited by examiner

*Primary Examiner* — Scott A Richmond
(74) *Attorney, Agent, or Firm* — Scully Scott Murphy and Presser

(57) ABSTRACT

A liquid ejection head includes: individual passages each having a nozzle; supply liquid passages each communicating with an individual inlet of a corresponding one of the individual passages; return liquid passages each communicating with an individual outlet of a corresponding one of the individual passages; a first supply coupling liquid passage coupling the supply liquid passages to each other and communicating with a first inlet of each of the supply liquid passages; and a second supply coupling liquid passage coupling the supply liquid passages to each other and communicating with a second inlet of each of the supply liquid passages. In each of the supply liquid passages, the individual inlet of the corresponding one of the individual passages is located between the first inlet and the second inlet.

17 Claims, 8 Drawing Sheets

LIQUID EJECTION HEAD

CROSS REFERENCE TO RELATED APPLICATION

The present application claims priority from Japanese Patent Application No. 2018-147608, which was filed on Aug. 6, 2018, the disclosure of which is herein incorporated by reference in its entirety.

BACKGROUND

The following disclosure relates to a liquid ejection head including a plurality of individual passages each having a nozzle.

There is known a liquid ejection head including: a plurality of second common liquid passages (supply liquid passages) each communicating with inlets of corresponding ones of a plurality of individual passages; and a plurality of first common liquid passages (return liquid passages) each communicating with outlets of corresponding ones of the plurality of individual passages. The first common liquid passages are joined together by a first joining liquid passage, and the second common liquid passages are joined together by a second joining liquid passage. Liquid is supplied from the second joining liquid passage to the second common liquid passages through their respective one ends. While flowing from the one end to the other end of each of the second common liquid passages, the liquid enters into the inlets of the respective individual passages communicating with the second common liquid passage. The liquid having flowed into each of the individual passages is partly ejected from a nozzle. The remaining portion of the liquid flows into a corresponding one of the first common liquid passages via the outlet of the individual passage. The liquid having flowed into the first common liquid passage flows from one end toward the other end of the first common liquid passage collected by the first joining liquid passage through the other end thereof.

SUMMARY

In the above-described liquid ejection head, the liquid is supplied from the second joining liquid passage to the one end of each of the second common liquid passages. The liquid flows from the one end toward the other end of the second common liquid passage and enters into the inlets of the respective individual passages communicating with the second common liquid passage. In this case, the pressure applied to each of the individual passages communicating with each of the second common liquid passages (the supply liquid passages) increases with decrease in distance to the one end of the second common liquid passage. Thus, the pressure to be applied varies among the individual passages communicating with each of the supply liquid passages, leading to a difference in amount of liquid to be ejected from the nozzle.

In the above-described liquid ejection head, the liquid having entered into each of the first common liquid passages flows from the one end toward the other end of the first common liquid passage and is collected by the first joining liquid passage through the other end thereof. In this case, the pressure applied to each of the individual passages communicating with each of the first common liquid passages (the return liquid passages) increases with increase in distance to the other end of the first common liquid passage. Thus, the pressure to be applied varies among the individual passages communicating with each of the return liquid passages, leading to a difference in amount of liquid to be ejected from the nozzle.

Accordingly, an aspect of the disclosure relates to a liquid ejection head with reduced variations in pressure to be applied among a plurality of individual passages.

In one aspect of the disclosure, a liquid ejection head includes: a plurality of individual passages each having a nozzle; a plurality of supply liquid passages each communicating with an individual inlet of a corresponding one of the plurality of individual passages; a plurality of return liquid passages each communicating with an individual outlet of a corresponding one of the plurality of individual passages; a first supply coupling liquid passage coupling the plurality of supply liquid passages to each other and communicating with a first inlet of each of the plurality of supply liquid passages; and a second supply coupling liquid passage coupling the plurality of supply liquid passages to each other and communicating with a second inlet of each of the plurality of supply liquid passages. In each of the plurality of supply liquid passages, the individual inlet of the corresponding one of the plurality of individual passages is located between the first inlet and the second inlet.

In another aspect of the disclosure, a liquid ejection head includes: a plurality of individual passages each having a nozzle; a plurality of supply liquid passages each communicating with an individual inlet of a corresponding one of the plurality of individual passages; a plurality of return liquid passages each communicating with an individual outlet of a corresponding one of the plurality of individual passages; a first return coupling liquid passage coupling the plurality of return liquid passages to each other and communicating with a first outlet of each of the plurality of return liquid passages; and a second return coupling liquid passage coupling the plurality of return liquid passages to each other and communicating with a second outlet of each of the plurality of return liquid passages. In each of the plurality of return liquid passages, the individual outlet of the corresponding one of the plurality of individual passages is located between the first outlet and the second outlet.

BRIEF DESCRIPTION OF THE DRAWINGS

The objects, features, advantages, and technical and industrial significance of the present disclosure will be better understood by reading the following detailed description of the embodiments, when considered in connection with the accompanying drawings, in which:

FIG. 3 is a cross-sectional view of the head 1, taken along line in

FIG. 2;

FIG. 4 is a cross-sectional view of the head 1, taken along line IV-IV in

FIG. 2;

EMBODIMENTS

First Embodiment

Figure 1:
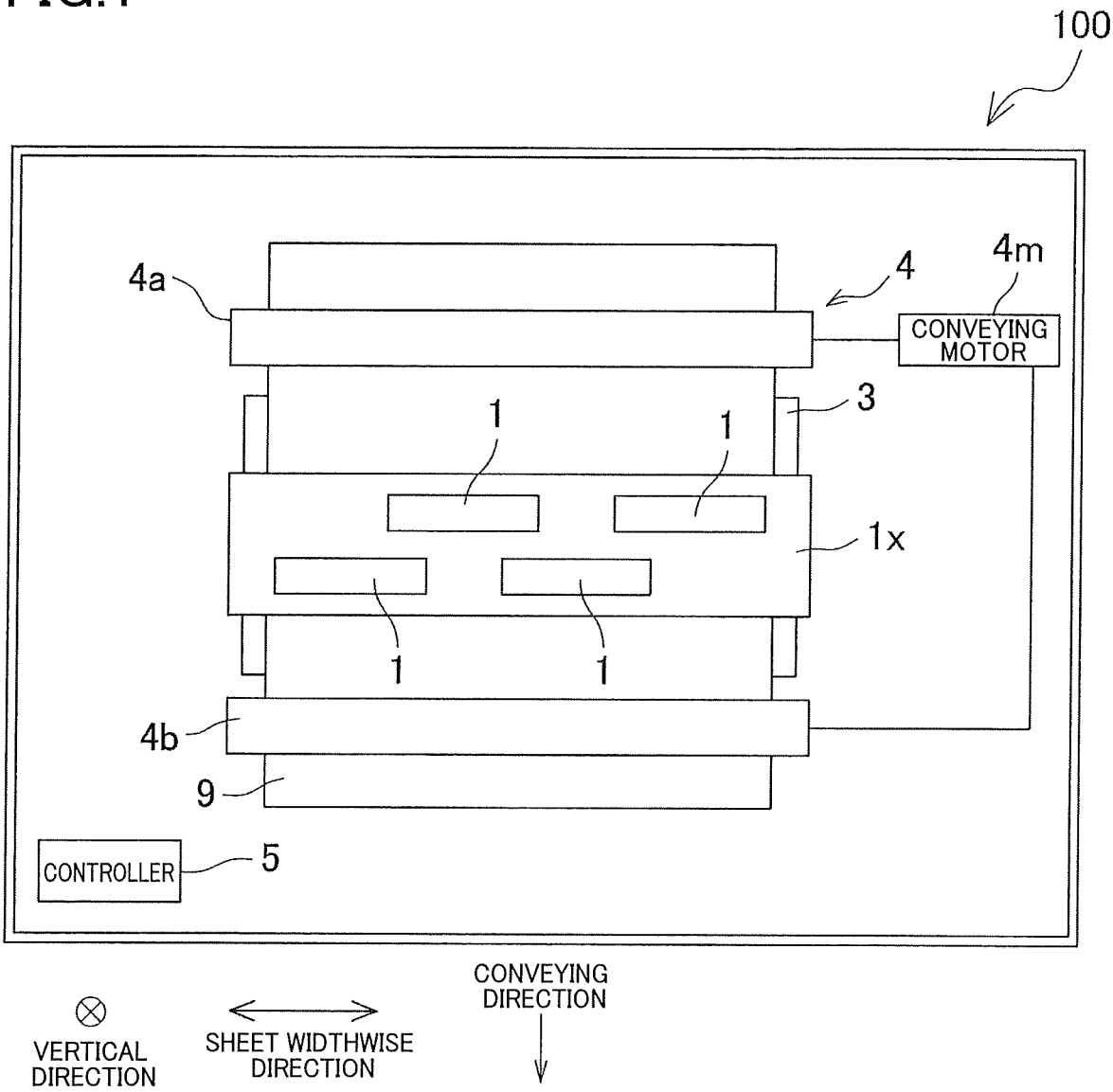
FIG. 1 is a plan view of a printer 100 including heads 1 according to a first embodiment.

Hereinafter, there will be described embodiments by reference to the drawings. First, there will be described, with reference to FIG. 1, an overall configuration of a printer 100 including heads 1 according to a first embodiment.

The printer 100 includes a head unit 1*x*, a platen 3, a conveying mechanism 4, and a controller 5. The head unit 1*x* includes the four heads 1.

An upper surface of the platen 3 is capable of supporting a sheet 9.

The conveying mechanism 4 includes two roller pairs 4*a*, 4*b*. The platen 3 is interposed between the two roller pairs 4*a*, 4*b* in a conveying direction. When a conveying motor 4*m* is driven by the controller 5, the roller pairs 4*a*, 4*b* are rotated in a state in which the sheet 9 is nipped by the roller pairs 4*a*, 4*b*, whereby the sheet 9 is conveyed in the conveying direction.

The head unit 1*x* is of a line type and elongated in a widthwise direction of the sheet 9. The line type is a type in which the head unit 1*x* ejects ink onto the sheet 9 from nozzles 21 (see FIGS. 2 and 3), with the position of the head unit 1*x* being fixed. The four heads 1 are arranged in the widthwise direction of the sheet 9 in a staggered configuration.

Figure 6:
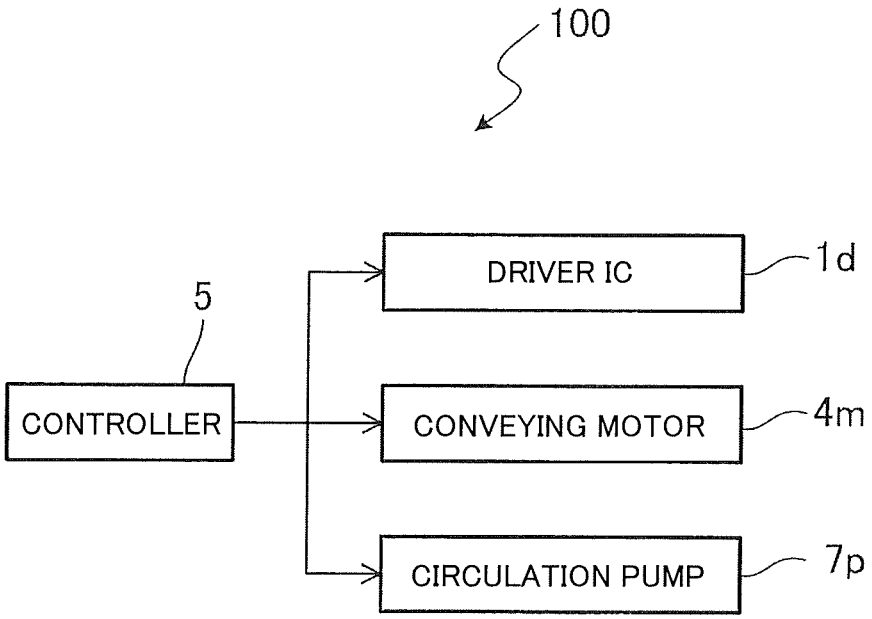
FIG. 6 is a block diagram illustrating an electric configuration of the printer 100.

The controller 5 includes a read-only memory (ROM), a random-access memory (RAM), and an application-specific integrated circuit (ASIC). The ASIC executes various processings, such as a recording processing, according to programs stored in the ROM. In the recording processing, the controller 5 controls the conveying motor 4*m* and a driver IC 1*d* of the head 1 (see FIGS. 3 and 6) to record an image on the sheet 9, based on a recording command (containing image data) input from an external device such as a personal computer (PC).

There will be next described a configuration of each of the heads 1 with reference to FIGS. 2-5B. Since the heads 1 have the same configuration, the configuration of one of the heads 1 will be described for simplicity.

The head 1 includes a liquid-passage defining plate 11 and an actuator unit 12.

Figure 3:
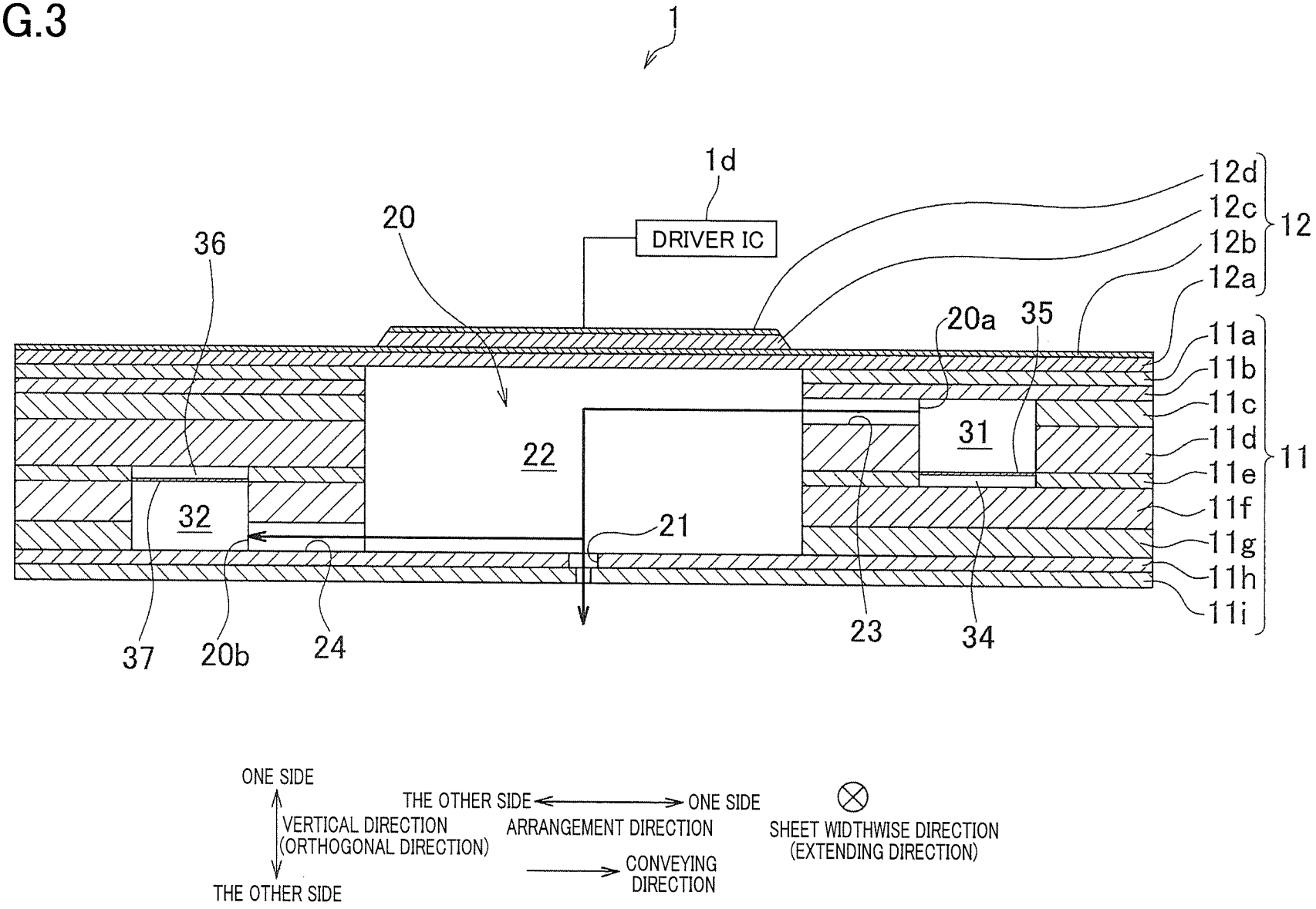
Figure 4:
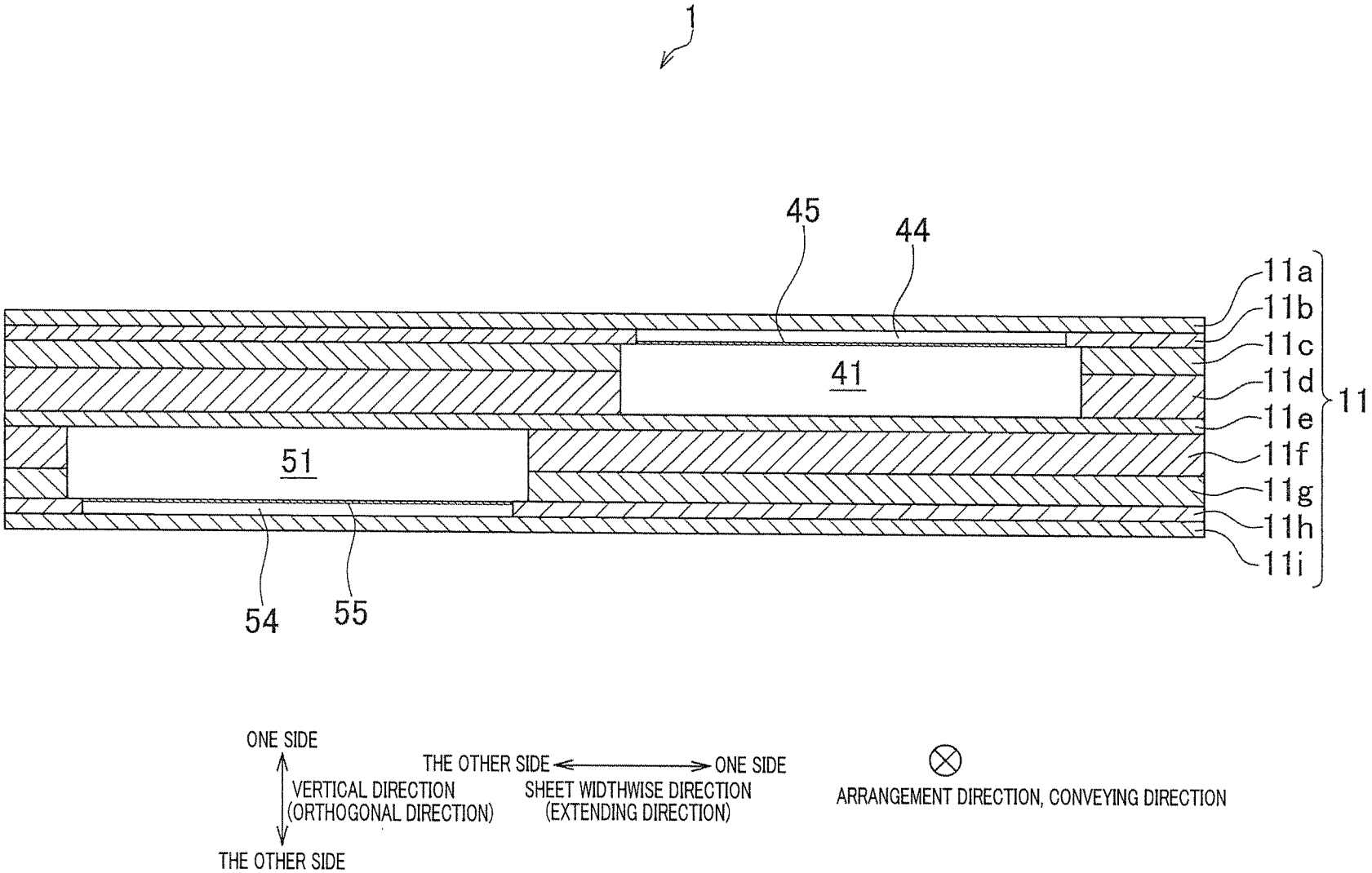

As illustrated in FIGS. 3 and 4, the liquid-passage defining plate 11 includes nine plates 11*a*-11*i* stacked on and bonded to each other. Each of the plates 11*a*-11*i* has through holes constituting liquid passages and openings formed in the liquid-passage defining plate 11.

Figure 2:
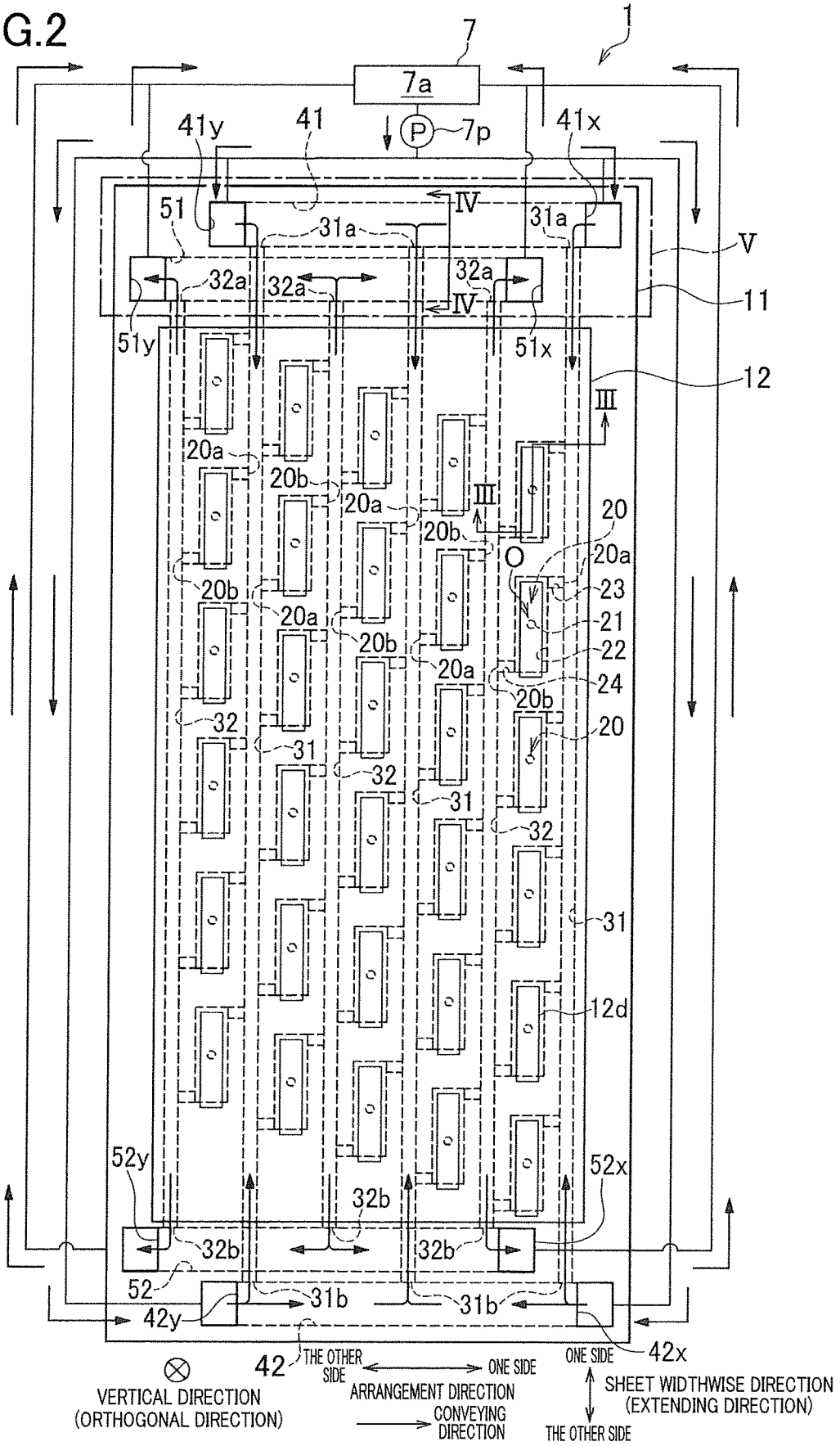
FIG. 2 is a plan view of the head 1.

As illustrated in FIG. 2, passages formed in the liquid-passage defining plate 11 include: a plurality of individual passages 20; a plurality of supply liquid passages 31 communicating with inlets 20*a* (each as one example of an individual inlet) of the respective individual passages 20; a plurality of return liquid passages 32 communicating with outlets 20*b* (each as one example of an individual outlet) of the respective individual passages 20; first and second supply coupling liquid passages 41, 42 each coupling the supply liquid passages 31 to each other; and first and second return coupling liquid passages 51, 52 each coupling the return liquid passages 32 to each other.

The supply liquid passages 31 and the return liquid passages 32 extend in the same direction that coincides with the widthwise direction of the sheet 9 and may be hereinafter referred to as "extending direction". The supply liquid passages 31 and the return liquid passages 32 are arranged in a direction along the conveying direction which may be hereinafter referred to as "arrangement direction". In the present embodiment, the arrangement direction is orthogonal to the extending direction. The supply liquid passages 31 and the return liquid passages 32 are alternately arranged in the arrangement direction.

Each of the supply liquid passages 31 has: a first inlet 31*a* formed at one end portion of the supply liquid passage 31 in the extending direction; and a second inlet 31*b* formed at the other end portion of the supply liquid passage 31 in the extending direction. Each of the supply liquid passage 31 communicates with the first supply coupling liquid passage 41 via the first inlet 31*a* and communicates with the second supply coupling liquid passage 42 via the second inlet 31*b*.

Each of the return liquid passages 32 has: a first outlet 32*a* formed at one end portion of the return liquid passage 32 in the extending direction; and a second outlet 32*b* formed at the other end portion of the return liquid passage 32 in the extending direction. Each of the return liquid passage 32 communicates with the first return coupling liquid passage 51 via the first outlet 32*a* and communicates with the second return coupling liquid passage 52 via the second outlet 32*b*.

Each of the supply coupling liquid passages 41, 42 and the return coupling liquid passages 51, 52 extends in the arrangement direction. The first supply coupling liquid passage 41 and the first return coupling liquid passage 51 are located on one side of the supply liquid passages 31 and the return liquid passages 32 in the extending direction and are located respectively at different positions in the extending direction. The second supply coupling liquid passage 42 and the second return coupling liquid passage 52 are located on the other side of the supply liquid passages 31 and the return liquid passages 32 in the extending direction and are located respectively at different positions in the extending direction. The first supply coupling liquid passage 41 and the second supply coupling liquid passage 42 are arranged so as to be symmetric with respect to a plane extending in the arrangement direction and the vertical direction through the center of the liquid-passage defining plate 11 in the extending direction. The first return coupling liquid passage 51 and the second return coupling liquid passage 52 are arranged so as to be symmetric with respect to the plane.

In the present embodiment, the first return coupling liquid passage 51 and the second return coupling liquid passage 52 are located between the first supply coupling liquid passage 41 and the second supply coupling liquid passage 42 in the extending direction.

The first supply coupling liquid passage 41 communicates at its other-side surface in the extending direction with the first inlets 31*a* of the respective supply liquid passages 31. The second supply coupling liquid passage 42 communicates at its one-side surface in the extending direction with the second inlets 31*b* of the respective supply liquid passages 31. The first return coupling liquid passage 51 communicates at its other-side surface in the extending direction with the first outlets 32*a* of the respective return liquid passages 32. The second return coupling liquid passage 52 communicates at its one-side surface in the extending direction with the second outlets 32*b* of the respective return liquid passages 32.

It is noted that, while left two of the supply liquid passages 31 in FIG. 2 have portions intersecting the first return coupling liquid passage 51 and the second return coupling liquid passage 52, the supply liquid passages 31 are located above the first return coupling liquid passage 51 and the second return coupling liquid passage 52. Specifically, as illustrated in FIGS. 3 and 4, the first supply coupling liquid passage 41, the second supply coupling liquid passage 42, and the plurality of supply liquid passages 31 are located on an upper (one) side of the first return coupling liquid passage 51, the second return coupling liquid passage 52, and the plurality of return liquid passages 32 in the vertical direction that is orthogonal to the extending direction and the arrangement direction and may be hereinafter referred to as "orthogonal direction".

As illustrated in FIG. 2, the first supply coupling liquid passage 41 communicates with a storage chamber 7*a* of a sub-tank 7 via two supply openings 41*x*, 41*y*. The two supply openings 41*x*, 41*y* are formed respectively at one and the other end portions of the first supply coupling liquid passage 41 in the arrangement direction. The supply openings 41*x*, 41*y* are located between coupled portions (i.e., the first inlets 31*a*) of the respective supply liquid passages 31.

The second supply coupling liquid passage 42 communicates with the storage chamber 7*a* via two supply openings 42*x*, 42*y*. The two supply openings 42*x*, 42*y* are formed respectively at one and the other end portions of the second supply coupling liquid passage 42 in the arrangement direction. The supply openings 42*x*, 42*y* are located between coupled portions (i.e., the second inlets 31*b*) of the respective supply liquid passages 31.

The first return coupling liquid passage 51 communicates with the storage chamber 7*a* via two return openings 51*x*, 51*y*. The return openings 51*x*, 51*y* are formed respectively at one and the other end portions of the first return coupling liquid passage 51 in the arrangement direction. The return openings 51*x*, 51*y* are located between coupled portions (i.e., the first outlets 32*a*) of the respective return liquid passages 32.

The second return coupling liquid passage 52 communicates with the storage chamber 7*a* via two return openings 52*x*, 52*y*. The return openings 52*x*, 52*y* are formed respectively at one and the other end portions of the second return coupling liquid passage 52 in the arrangement direction. The return openings 52*x*, 52*y* are located between coupled portions (i.e., the second outlets 32*b*) of the respective return liquid passages 32.

The sub-tank 7 is installed in the head 1. The storage chamber 7*a* communicates with a main tank, not illustrated, for storing the ink and stores the ink supplied from the main tank.

The individual passages 20 are arranged between the coupling liquid passages 41, 51 and the coupling liquid passages 42, 52 in the extending direction. The inlet 20*a* of each of the individual passages 20 is formed between the first inlet 31*a* and the second inlet 31*b* of a corresponding one of the supply liquid passages 31. The outlet 20*b* of each of the individual passages 20 is formed between the first outlet 32*a* and the second outlet 32*b* of a corresponding one of the return liquid passages 32.

Each of the individual passages 20 is formed between a corresponding one of the supply liquid passages 31 and a corresponding one of the return liquid passages 32 which are adjacent to each other in the arrangement direction. The individual passages 20 are arranged in five rows, in each of which the individual passages 20 each extending in the extending direction are arranged in the extending direction. The five rows are arranged in the arrangement direction. The supply liquid passage 31 and the return liquid passage 32 are formed on opposite sides of each of the rows of the individual passages 20 in the arrangement direction. In the present embodiment, the supply liquid passage 31 or the return liquid passage 32 formed between two of the rows of the individual passages 20 which are adjacent to each other in the arrangement direction communicates with the individual passages 20 belonging to the two rows. Here, each of first individual passages belonging to the rightmost one of the five rows of the individual passages 20 in FIG. 2 communicates with a first supply liquid passage as one of the supply liquid passages 31 (the rightmost supply liquid passage 31 in FIG. 2) and a first return liquid passage as one of the return liquid passages 32 (the rightmost return liquid passage 32 in FIG. 2) via the inlet 20*a* and the outlet 20*b*. The first supply liquid passage is located on one side (a right side in FIG. 2) of the first individual passages in the arrangement direction, and the first return liquid passage is located on the other side (a left side in FIG. 2) of the first individual passages in the arrangement direction. As is obvious from FIG. 2, each of the inlets 20*a* of the respective individual passages 20 is located between the coupling liquid passages 41, 42 and between the coupling liquid passages 51, 52 in the extending direction. Likewise, each of the outlets 20*b* of the respective individual passages is located between the coupling liquid passages 41, 42 and between the coupling liquid passages 51, 52 in the extending direction.

As illustrated in FIGS. 2 and 3, each of the individual passages 20 includes: the nozzle 21; a pressure chamber 22 communicating with the nozzle 21; an inflow passage 23 connecting the pressure chamber 22 and the inlet 20*a* to each other; and an outflow passage 24 connecting the pressure chamber 22 and the outlet 20*b* to each other. As illustrated in FIG. 2, the pressure chamber 22 is of a rectangular shape extending in the extending direction on the plane extending along the extending direction and the arrangement direction. The pressure chamber 22 has four corner portions and four sides. The nozzle 21 is located just under the pressure chamber 22 at the center point O of the pressure chamber 22 on the plane. The inflow passage 23 and the outflow passage 24 extend in the arrangement direction respectively from two of the four sides of the pressure chamber 22, which two are opposed to each other in the arrangement direction. The inflow passage 23 and the outflow passage 24 connected respectively to two of the four corner portions of the pressure chamber 22, which two are symmetric with respect to the center point O. The inflow passage 23 and the outflow passage 24 are arranged so as to be symmetric with respect to the center point O. Likewise, the inlet 20*a* and the outlet 20*b* are arranged so as to be symmetric with respect to the center point O.

As illustrated in FIG. 3, the nozzle 21 is constituted by through holes formed in the respective plates 11*h*, 11*i*. The pressure chamber 22 is constituted by through holes formed in the respective plates 11*a*-11*g*. The inflow passage 23 is constituted by a through hole formed in the plate 11*c*. The outflow passage 24 is constituted by a through hole formed in the plate 11*g*.

The supply liquid passage 31 is constituted by through holes formed in the respective plates 11*c*, 11*d*. The return liquid passage 32 is constituted by through holes formed in the respective plates 11*f*, 11*g*.

Damper films 35 are provided in the respective supply liquid passages 31. Damper films 37 are provided in the respective return liquid passages 32. Each of the damper films 35 defines a lower surface of a corresponding one of the supply liquid passages 31. Each of the damper films 37 defines an upper surface of a corresponding one of the return liquid passages 32. Specifically, the plate 11*e* has: a through hole serving as a damper chamber 34 at a region located under the supply liquid passage 31; and a through hole serving as a damper chamber 36 at a region located over the return liquid passage 32. The damper film 35 is mounted on an upper surface of the plate 11*e* so as to cover the damper chamber 34, and the damper film 37 is mounted on a lower surface of the plate 11*e* so as to cover the damper chamber 36.

As illustrated in FIG. 4, each of the supply coupling liquid passages 41, 42 is constituted by through holes formed in the respective plates 11*c*, 11*d*. Each of the return coupling liquid passages 51, 52 is constituted by through holes formed in the respective plates 11*f*, 11*g*.

Figure 5A:
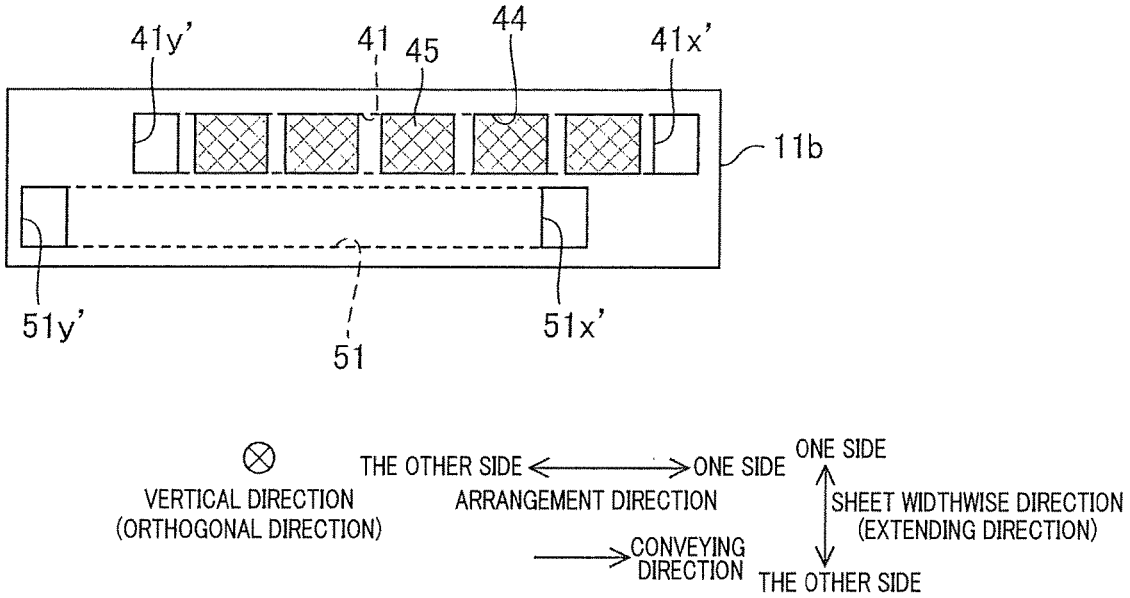
FIG. 5A is a plan view of a plate 11*b* constituting a liquid-passage defining plate 11 of the head 1 at a region Vin FIG. 2.
Figure 5B:
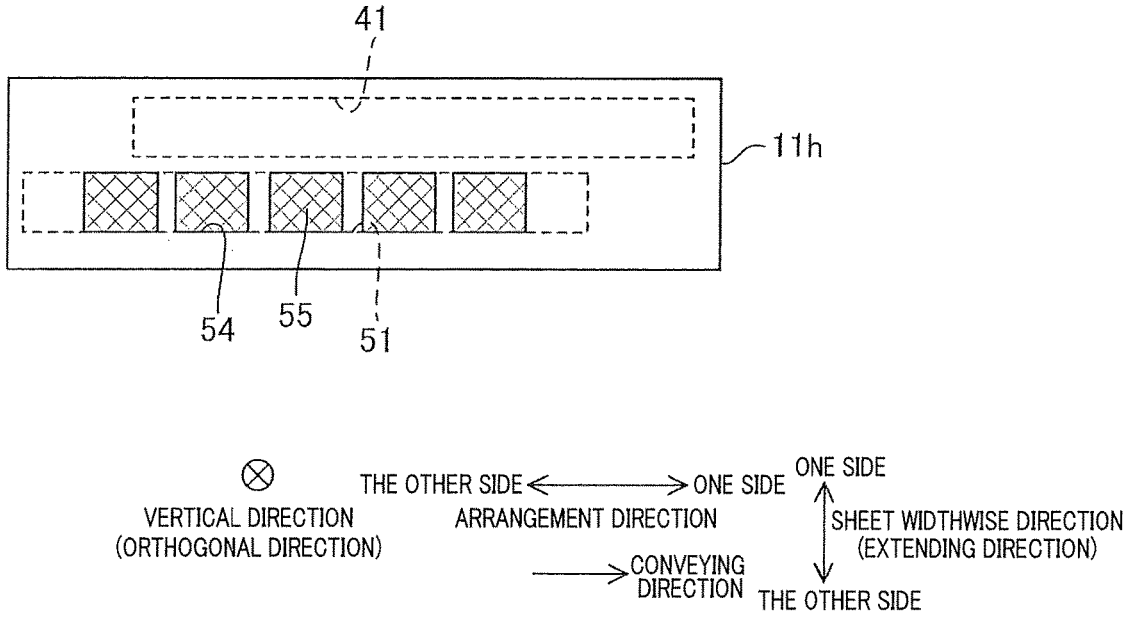
FIG. 5B is a plan view of a plate 11*h* constituting the liquid-passage defining plate 11 of the head 1 at the region V in FIG. 2.

As illustrated in FIGS. 4-5B, five damper films 45 separated from each other in the arrangement direction are provided on each of the supply coupling liquid passages 41, 42. Five damper films 55 separated from each other in the arrangement direction are provided on each of the return coupling liquid passages 51, 52. Each of the damper films 45 defines an upper surface of a corresponding one of the supply coupling liquid passages 41, 42. Each of the damper films 55 defines a lower surface of a corresponding one of the return coupling liquid passages 51, 52. Specifically, the plate 11*b* has through holes serving as five damper chambers 44 at regions located over each of the supply coupling liquid passages 41, 42. The damper films 45 are mounted on a lower surface of the plate 11*b* so as to cover the respective damper chambers 44. The plate 11*b* has through holes serving as five damper chambers 54 at regions located under each of the return coupling liquid passages 51, 52. The damper films 55 are mounted on an upper surface of the plate 11*h* so as to cover the respective damper chambers 54.

Each of the damper films 35, 37, 45, 55 is a film-like member with a thickness that is less than that of each of the plates 11*a*-11*i*. The damper films 45, 55 are hatched in FIGS. 5A and 5B.

It is noted that as illustrated in FIG. 5A, the plate 11*b* has: through holes 41*x*', 41*y*' continuing to the respective supply openings 41*x*, 41*y*; and through holes 51*x*', 51*y*' continuing to the respective return openings 51*x*, 51*y*. Though not illustrated, the plate 11*b* has: through holes continuing to the respective supply openings 42*x*, 42*y*; and through holes continuing to the respective return openings 52*x*, 52*y*.

Here, there will be described the flow of ink in the liquid-passage defining plate 11. The arrows in FIGS. 2 and 3 indicate the flow of the ink.

As illustrated in FIG. 2, when the controller 5 drives a circulation pump 7*p*, the ink in the storage chamber 7*a* is supplied from the supply openings 41*x*, 41*y* to the first supply coupling liquid passage 41 and from the supply openings 42*x*, 42*y* to the second supply coupling liquid passage 42. The ink supplied from the supply opening 41*x* to the first supply coupling liquid passage 41 flows in the first supply coupling liquid passage 41 from the one side toward the other side in the arrangement direction and enters into the first inlets 31*a* of the respective supply liquid passages 31. The ink supplied from the supply opening 41*y* to the first supply coupling liquid passage 41 flows in the first supply coupling liquid passage 41 from the other side toward the one side in the arrangement direction and enters into the first inlets 31*a* of the respective supply liquid passages 31. The ink supplied from the supply opening 42*x* to the second supply coupling liquid passage 42 flows in the second supply coupling liquid passage 42 from the one side toward the other side in the arrangement direction and enters into the second inlets 31*b* of the respective supply liquid passages 31. The ink supplied from the supply opening 42*y* to the second supply coupling liquid passage 42 flows in the second supply coupling liquid passage 42 from the other side toward the one side in the arrangement direction and enters into the second inlets 31*b* of the respective supply liquid passages 31.

The ink having flowed in the first inlets 31*a* of the respective supply liquid passages 31 flows in the supply liquid passages 31 from the one side toward the other side in the extending direction and enters into the inlets 20*a* of the respective individual passages 20. The ink having flowed in the second inlets 31*b* of the respective supply liquid passages 31 flows in the supply liquid passages 31 from the other side toward the one side in the extending direction and enters into the inlets 20*a* of the respective individual passages 20.

In each of the individual passages 20, as illustrated in FIG. 3, the ink having flowed from the supply liquid passage 31 into the inlet 20*a* enters into the pressure chamber 22 through the inflow passage 23, and a portion of the ink is ejected from the nozzle 21 while the remaining ink flows from the outlet 20*b* into the return liquid passage 32 through the outflow passage 24.

As illustrated in FIG. 2, the ink having flowed in the return liquid passages 32 flows in the return liquid passages 32 from the other side toward the one side in the extending direction and enters from the first outlets 32*a* into the first return coupling liquid passage 51, or flows in the return liquid passages 32 from the one side toward the other side in the extending direction and enters from the second outlets 32*b* into the second return coupling liquid passage 52. The ink having flowed in the first return coupling liquid passage 51 flows in the first return coupling liquid passage 51 from the other side toward the one side in the arrangement direction enters from the return opening 51*x* back into the storage chamber 7*a*, or flows in the first return coupling liquid passage 51 from the one side toward the other side in the arrangement direction and enters from the return opening 51*y* back into the storage chamber 7*a*. The ink having flowed in the second return coupling liquid passage 52 flows in the second return coupling liquid passage 52 from the other side toward the one side in the arrangement direction and enters from the return opening 52*x* back into the storage chamber 7*a*, or flows in the second return coupling liquid passage 52 from the one side toward the other side in the arrangement direction and enters from the return opening 52*y* back into the storage chamber 7*a*.

This circulation of the ink between the storage chamber 7*a* and each of the individual passages 20 enables discharge of air bubbles from the individual passages 20 and prevents increase in viscosity of the ink. Furthermore, in the case where the ink contains components with a possibility of settling, such as pigments, the components are stirred, thereby preventing settling of the components.

The actuator unit 12 is disposed on an upper surface of the liquid-passage defining plate 11 so as to cover the pressure chambers 22.

As illustrated in FIG. 3, the actuator unit 12 includes a vibration plate 12*a*, a common electrode 12*b*, a plurality of piezoelectric elements 12*c*, and a plurality of individual electrodes 12*d* stacked in order from below. The vibration plate 12*a* and the common electrode 12*b* cover the pressure chambers 22. Each of the piezoelectric elements 12*c* and each of the individual electrodes 12*d* are provided for a corresponding one of the pressure chambers 22 so as to be opposed to the corresponding pressure chamber 22 in the orthogonal direction.

The individual electrodes 12*d* and the common electrode 12*b* are electrically connected to the driver IC 1*d*. The driver IC 1*d* keeps the electric potential of the common electrode

12*b* at the ground potential and changes the electric potential of each of the individual electrodes 12*d*. Specifically, the driver IC 1*d* creates drive signals based on control signals output from the controller 5 and transmits the drive signals to the individual electrodes 12*d*. As a result, the electric potential of each of the individual electrodes 12*d* is changed between a predetermined driving potential and the ground potential. In this operation, for each of the piezoelectric elements 12*c*, portions of the vibration plate 12*a* and the piezoelectric element 12*c* which are located between a corresponding one of the individual electrodes 12*d* and a corresponding one of the pressure chambers 22 are deformed so as to protrude toward the pressure chamber 22. This changes the volume of the pressure chamber 22, so that a pressure is applied to the ink in the pressure chamber 22 to eject the ink from a corresponding one of the nozzles 21.

The head 1 according to the present embodiment as described above includes: the first supply coupling liquid passage 41 coupling the supply liquid passages 31 to each other and communicating with the first inlets 31*a* of the respective supply liquid passages 31; and the second supply coupling liquid passage 42 coupling the supply liquid passages 31 to each other and communicating with the second inlets 31*b* of the respective supply liquid passages 31 (see FIG. 2). In each of the supply liquid passages 31, the inlets 20*a* of the respective individual passages 20 are formed between the first inlet 31*a* and the second inlet 31*b*. Thus, the ink is supplied to the individual passages 20 from both of the first inlet 31*a* and the second inlet 31*b* in each of the supply liquid passages 31. With this configuration, the pressure applied to each of the individual passages 20 communicating with each of the supply liquid passages 31 increases with decrease in distance to the first inlet 31*a* or the second inlet 31*b*, but variation in the applied pressure is reduced when compared with the case where the ink is supplied from one inlet of each of the supply liquid passages 31.

The head 1 according to the present embodiment includes: the first return coupling liquid passage 51 coupling the return liquid passages 32 to each other and communicating with the first outlets 32*a* of the respective return liquid passages 32; and the second return coupling liquid passage 52 coupling the return liquid passages 32 to each other and communicating with the second outlets 32*b* of the respective return liquid passages 32 (see FIG. 2). In each of the return liquid passages 32, the outlets 20*b* of the respective individual passages 20 are formed between the first outlet 32*a* and the second outlet 32*b*. Thus, the ink is collected from both of the first outlet 32*a* and the second outlet 32*b* in each of the return liquid passages 32. With this configuration, the pressure applied to each of the individual passages 20 communicating with each of the return liquid passages 32 increases with increase in distance to the first outlet 32*a* or the second outlet 32*b*, but variation in the applied pressure is reduced when compared with the case where the ink is collected from one outlet of each of the return liquid passages 32.

The supply liquid passages 31 and the return liquid passages 32 extend in the same direction (the extending direction) and are arranged in the arrangement direction intersecting the extending direction (see FIG. 2). The first supply coupling liquid passage 41 and the first return coupling liquid passage 51 extend in the arrangement direction and are located on the one side of the supply liquid passages 31 and the return liquid passages 32 in the extending direction. The second supply coupling liquid passage 42 and the second return coupling liquid passage 52 extend in the arrangement direction and are located on the other side of the supply liquid passages 31 and the return liquid passages 32 in the extending direction. If the liquid passages 31, 32, 41, 42, 51, 52 are arranged on a random basis, the entire size of the liquid passages on the plane extending along the extending direction and the arrangement direction may increase. In the present embodiment, in contrast, each of the extending direction and the arrangement direction of each of the liquid passages 31, 32, 41, 42, 51, 52 coincides with the extending direction or the arrangement direction as described above, resulting in reduction in the entire size of the liquid passages on the plane.

If the first supply coupling liquid passage 41 and the first return coupling liquid passage 51 are located at the same position in the extending direction, the first supply coupling liquid passage 41 and the first return coupling liquid passage 51 overlap each other in the orthogonal direction. In this case, it is difficult to form the supply openings 41*x*, 41*y* and the return openings 51*x*, 51*y* in the upper surface of the liquid-passage defining plate 11, which may make it difficult to mount tubes and so on to the supply openings 41*x*, 41*y* and the return openings 51*x*, 51*y*. If the lengths of the first supply coupling liquid passage 41 and the first return coupling liquid passage 51 in the orthogonal direction are increased in the case where the first supply coupling liquid passage 41 and the first return coupling liquid passage 51 overlap each other in the orthogonal direction, the entire size of the liquid passages in the orthogonal direction increases, unfortunately. In the present embodiment, in contrast, the first supply coupling liquid passage 41 and the first return coupling liquid passage 51 are located respectively at different positions in the extending direction (see FIG. 2). Thus, the supply openings 41*x*, 41*y* and the return openings 51*x*, 51*y* are easily formed in the upper surface of the liquid-passage defining plate 11, whereby the tubes and so on can be easily mounted to the supply openings 41*x*, 41*y* and the return openings 51*x*, 51*y*. Also, even in the case where the lengths of the first supply coupling liquid passage 41 and the first return coupling liquid passage 51 in the orthogonal direction are increased, increase in the entire size of the liquid passages in the orthogonal direction is difficult. This applies to the second supply coupling liquid passage 42 and the second return coupling liquid passage 52.

If the first return coupling liquid passage 51 is located between the first supply coupling liquid passage 41 and the second supply coupling liquid passage 42 in the extending direction, and the second return coupling liquid passage 52 is located on the other side of the second supply coupling liquid passage 42 in the extending direction, or if the second return coupling liquid passage 52 is located between the first supply coupling liquid passage 41 and the second supply coupling liquid passage 42 in the extending direction, and the first return coupling liquid passage 51 is located on the one side of the first supply coupling liquid passage 41 in the extending direction, variation in loss of the pressure is easily caused between the first supply coupling liquid passage 41 and the second supply coupling liquid passage 42 and between the first return coupling liquid passage 51 and the second return coupling liquid passage 52. If the liquid-passage defining plate 11 is rotated by 180 degrees about an axis extending in the orthogonal direction through the center of the liquid-passage defining plate 11 in the extending direction and the arrangement direction in each of the above-described cases, the arrangement of the supply coupling liquid passages 41, 42 and the return coupling liquid passages 51, 52 is changed, which may cause a malfunction in communication between each coupling liquid passage and the storage chamber 7*a*. In the present embodiment, in contrast, the first return coupling liquid passage 51 and the second return coupling liquid passage 52 are located between the first supply coupling liquid passage 41 and the second supply coupling liquid passage 42 in the extending direction (see FIG. 2). This configuration reduces the above-described problem.

The first supply coupling liquid passage 41 communicates with the storage chamber 7*a* via the two supply openings 41*x*, 41*y* formed such that the coupled portions of the respective supply liquid passages 31 are interposed between the supply openings 41*x*, 41*y* (see FIG. 2). With this configuration, the length of a liquid passage through which the ink flows in the first supply coupling liquid passage 41 from each of the supply openings 41*x*, 41*y* is about a half of the length of a liquid passage through which the ink flows in the first supply coupling liquid passage 41 from one of the two supply openings 41*x*, 41*y*, resulting in reduction in loss of the pressure in the first supply coupling liquid passage 41. This applies to the second supply coupling liquid passage 42.

The first return coupling liquid passage 51 communicates with the storage chamber 7*a* via the two return openings 51*x*, 51*y* formed such that the coupled portions of the respective return liquid passages 32 are interposed between the return openings 51*x*, 51*y* (see FIG. 2). With this configuration, the length of a liquid passage through which the ink flows from the first return coupling liquid passage 51 toward each of the return openings 51*x*, 51*y* is about a half of the length of a liquid passage through which the ink flows from the first return coupling liquid passage 51 toward one of the return openings 51*x*, 51*y*, resulting in reduction in loss of the pressure in the first return coupling liquid passage 51. This applies to the second return coupling liquid passage 52.

At least a portion of each of the first supply coupling liquid passage 41 and the second supply coupling liquid passage 42 is defined by a corresponding one of the damper films 45 (see FIG. 4). This configuration reduces fluid crosstalk between the supply liquid passages 31 and by extension between the individual passages 20.

At least a portion of each of the first return coupling liquid passage 51 and the second return coupling liquid passage 52 is defined by a corresponding one of the damper films 55 (see FIG. 4). This configuration reduces fluid crosstalk between the return liquid passages 32 and by extension between the individual passages 20. The damper films 55 provided for the respective return coupling liquid passages 51, 52 reduce the fluid crosstalk between the individual passages 20 more effectively than the damper films 45 provided for the respective supply coupling liquid passages 41, 42. This configuration reduces the fluid crosstalk between the individual passages 20 more effectively.

In each of the first supply coupling liquid passage 41, the second supply coupling liquid passage 42, the first return coupling liquid passage 51, and the second return coupling liquid passage 52, a corresponding one of the damper films 45, 55 is provided at the surface (i.e., the upper or lower surface) different from the side surface communicating with any of the inlets 31*a*, 31*b* of the supply liquid passages 31 and the outlets 32*a*, 32*b* of the return liquid passages 32 (see FIGS. 2 and 4). Since each of the inlets 31*a*, 31*b* and the outlets 32*a*, 32*b* is formed in the side surface of a corresponding one of the coupling liquid passages 41, 42, 51, 52, it is difficult to provide the damper film at the side surface. In the present embodiment, this problem is reduced.

If the damper film is located between the coupling liquid passages 41, 51, a component for supporting the damper film needs to be provided between the coupling liquid passages 41, 51, which may result in complicated configuration between the coupling liquid passages 41, 51. In the present embodiment, in contrast, the first supply coupling liquid passage 41 is located on the one side of the first return coupling liquid passage 51 in the orthogonal direction, and the damper film 45 provided on the first supply coupling liquid passage 41 is located on the one side of the first supply coupling liquid passage 41 in the orthogonal direction (see FIG. 4). The damper film 55 provided on the first return coupling liquid passage 51 is located on the other side of the first return coupling liquid passage 51 in the orthogonal direction. This configuration reduces the above-described problem.

Likewise, if the damper film is located between the coupling liquid passages 42, 52, a component for supporting the damper film needs to be provided between the coupling liquid passages 42, 52, which may result in complicated configuration between the coupling liquid passages 42, 52. In the present embodiment, in contrast, the second supply coupling liquid passage 42 is located on the one side of the second return coupling liquid passage 52 in the orthogonal direction, and the damper film 45 provided on the second supply coupling liquid passage 42 is located on the one side of the second supply coupling liquid passage 42 in the orthogonal direction. The damper film 55 provided on the second return coupling liquid passage 52 is located on the other side of the second return coupling liquid passage 52 in the orthogonal direction. This configuration reduces the above-described problem.

If one damper film elongated in the arrangement direction is provided for each of the coupling liquid passages 41, 42, 51, 52, it is difficult to adjust the damping performance. It is difficult to evenly bond the one damper film elongated in the arrangement direction, and the volume of the liquid passage may change depending upon the flatness of the damper film. In the present embodiment, in contrast, the five damper films (45 or 55) spaced apart from each other in the arrangement direction are provided for each of the coupling liquid passages 41, 42, 51, 52 (see FIGS. 5A and 5B). Thus, the damping performance is easily adjusted depending upon the individual characteristic of the five damper films (45 or 55). Since each of the five damper films (45 or 55) has a relatively small length in the arrangement direction, it is possible to reduce the difficulty of bonding and a problem in which there is a possibility of change in the volume of the liquid passage.

At least a portion of each of the supply liquid passages 31 and the return liquid passages 32 is defined by the damper film (see FIG. 3). This reduces the fluid crosstalk between the individual passages 20.

Second Embodiment

Figure 7:
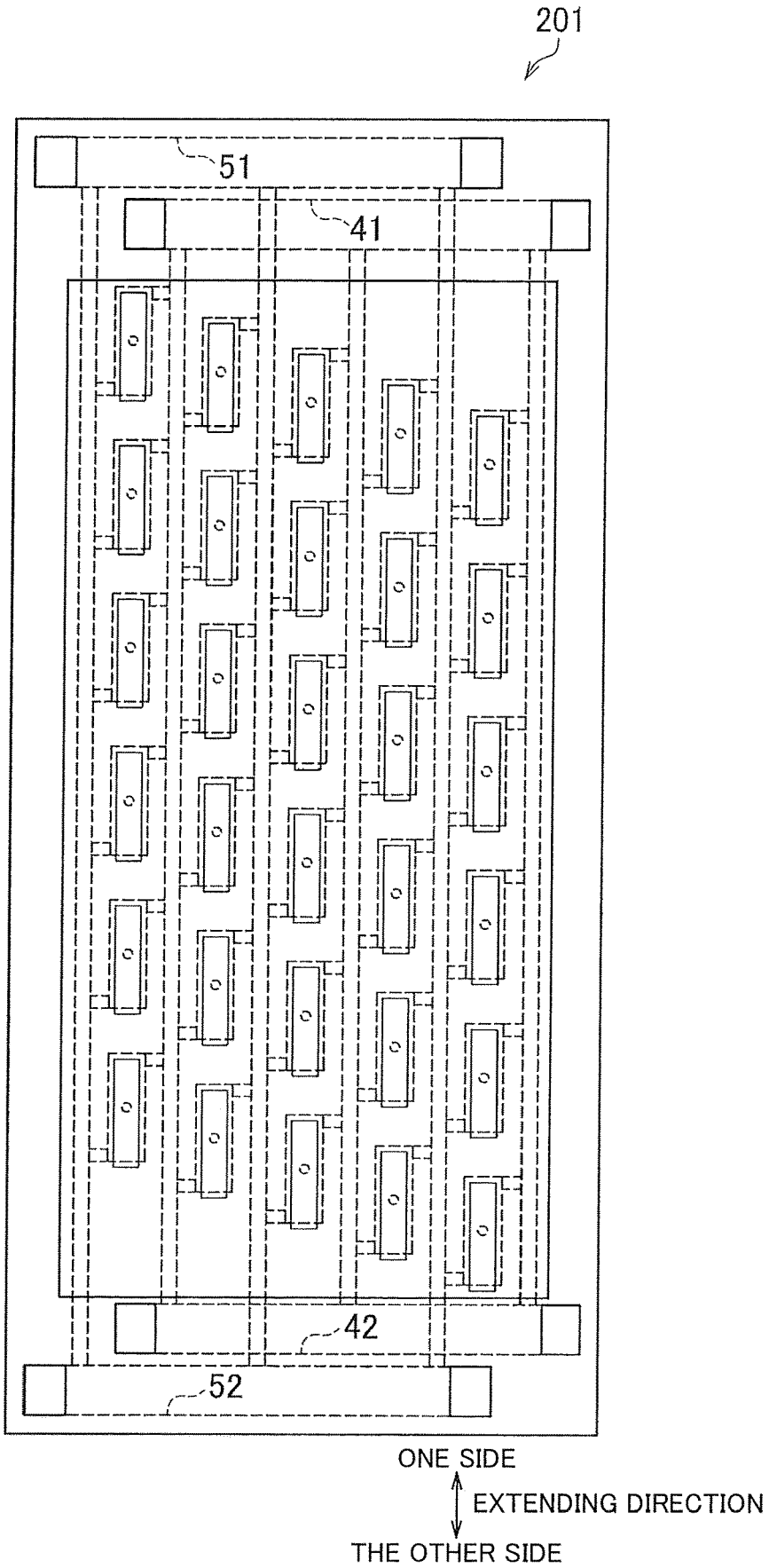
FIG. 7 is a plan view of a head 201 according to a second embodiment.

There will be next described a head 201 according to a second embodiment with reference to FIG. 7. The present embodiment is different from the first embodiment in arrangement of the coupling liquid passages 41, 42, 51, 52.

In the first embodiment, the first return coupling liquid passage 51 and the second return coupling liquid passage 52 are located between the first supply coupling liquid passage 41 and the second supply coupling liquid passage 42 in the extending direction (see FIG. 2).

In the present embodiment, the first supply coupling liquid passage 41 and the second supply coupling liquid passage 42 are located between the first return coupling liquid passage 51 and the second return coupling liquid passage 52 in the extending direction.

If the first supply coupling liquid passage 41 is located between the first return coupling liquid passage 51 and the second return coupling liquid passage 52 in the extending direction, and the second supply coupling liquid passage 42 is located on the other side of the second return coupling liquid passage 52 in the extending direction, or if the second supply coupling liquid passage 42 is located between the first return coupling liquid passage 51 and the second return coupling liquid passage 52 in the extending direction, and the first supply coupling liquid passage 41 is located on the one side of the first return coupling liquid passage 51 in the extending direction, variation in loss of the pressure is easily caused between the first supply coupling liquid passage 41 and the second supply coupling liquid passage 42 and between the first return coupling liquid passage 51 and the second return coupling liquid passage 52. If the liquid-passage defining plate 11 is rotated by 180 degrees about the axis extending in the orthogonal direction through the center of the liquid-passage defining plate 11 in the extending direction and the arrangement direction in each of the above-described cases, the arrangement of the supply coupling liquid passages 41, 42 and the return coupling liquid passages 51, 52 is changed, which may cause a malfunction in communication between each coupling liquid passage and the storage chamber 7*a*. In the present embodiment, in contrast, the first supply coupling liquid passage 41 and the second supply coupling liquid passage 42 are located between the first return coupling liquid passage 51 and the second return coupling liquid passage 52 in the extending direction. This configuration reduces the above-described problem.

Third Embodiment

Figure 8:
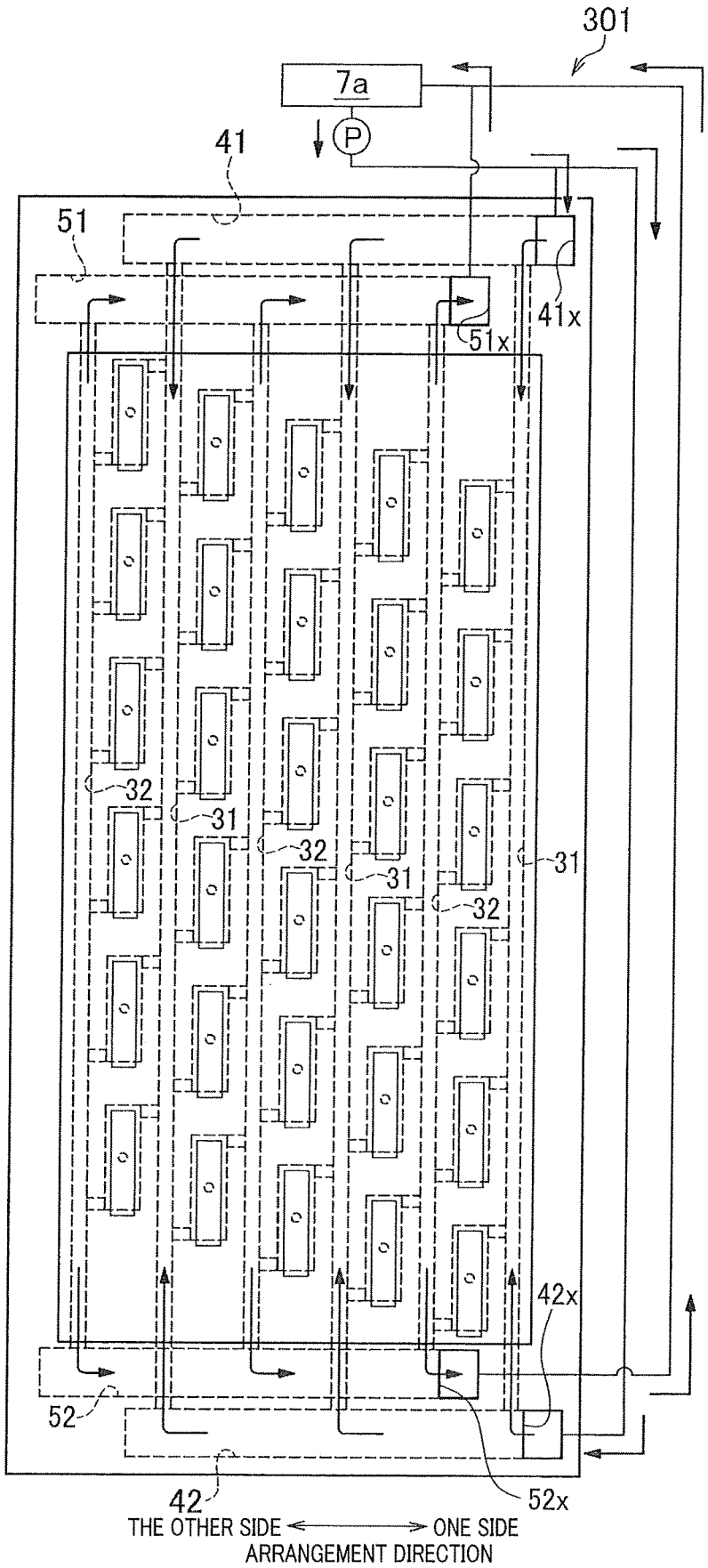
FIG. 8 is a plan view of a head 301 according to a third embodiment.

There will be next described a head 301 according to a third embodiment with reference to FIG. 8. The present embodiment is different from the first embodiment in configurations of supply openings and return openings.

In the first embodiment, the first supply coupling liquid passage 41 communicates with the storage chamber 7*a* via the two supply openings 41*x*, 41*y* with the coupled portions of the respective supply liquid passages 31 between the two supply openings 41*x*, 41*y*, the second supply coupling liquid passage 42 communicates with the storage chamber 7*a* via the two supply openings 42*x*, 42*y* with the coupled portions of the respective supply liquid passages 31 between the two supply openings 42*x*, 42*y*, the first return coupling liquid passage 51 communicates with the storage chamber 7*a* via the two return openings 51*x*, 51*y* with the coupled portions of the respective return liquid passages 32 between the two return openings 51*x*, 51*y*, and the second return coupling liquid passage 52 communicates with the storage chamber 7*a* via the two return openings 52*x*, 52*y* with the coupled portions of the respective return liquid passages 32 between the two return openings 52*x*, 52*y* (see FIG. 2).

In the present embodiment, each of the first supply coupling liquid passage 41 and the second supply coupling liquid passage 42 communicates with the storage chamber 7*a* via a corresponding one of the supply openings 41*x*, 42*x* which is located on the one side of the coupled portions of the respective supply liquid passages 31 in the arrangement direction, and each of the first return coupling liquid passage 51 and the second return coupling liquid passage 52 communicates with the storage chamber 7*a* via a corresponding one of the return openings 51*x*, 52*x* which is located on the one side of the coupled portions of the respective return liquid passages 32 in the arrangement direction.

If the supply openings 41*x*, 42*x* are located on the one side of the coupled portions of the respective supply liquid passages 31 in the arrangement direction, and the return openings 51*x*, 52*x* are located on the other side of the coupled portions of the respective return liquid passages 32 in the arrangement direction, the pressure applied to each of the inlets 20*a* and the outlets 20*b* of the individual passages 20 increases with decrease in distance to the supply opening 41*x* or 42*x* in the arrangement direction, and the pressure applied to each of the inlets 20*a* and the outlets 20*b* of the individual passages 20 decreases with increase in distance to the supply opening 41*x* or 42*x* in the arrangement direction (i.e., with decrease in distance to the return opening 51*x* or 52*x*). This results in a larger distribution of the pressure applied to each of the individual passages 20, leading to a case where a meniscus of the ink is not maintained. In the present embodiment, in contrast, the supply openings 41*x*, 42*x* are located on the one side of the coupled portions of the respective supply liquid passages 31 in the arrangement direction, and the return openings 51*x*, 52*x* are located on the one side of the coupled portions of the respective return liquid passages 32 in the arrangement direction, making it possible to reduce the above-described problems.

Modifications

While the embodiments have been described above, it is to be understood that the disclosure is not limited to the details of the illustrated embodiments, but may be embodied with various changes and modifications, which may occur to those skilled in the art, without departing from the spirit and scope of the disclosure.

In the above-described embodiments, both the supply coupling liquid passages and the return coupling liquid passages are provided. However, the return coupling liquid passages or the supply coupling liquid passages may be omitted.

The positional relationship among the coupling liquid passages in the extending direction is not limited in particular. For example, the head may be configured such that the first return coupling liquid passage is located between the first supply coupling liquid passage and the second supply coupling liquid passage in the extending direction, and the second return coupling liquid passage is located on the other side of the second supply coupling liquid passage in the extending direction. The head may be configured such that the second return coupling liquid passage is located between the first supply coupling liquid passage and the second supply coupling liquid passage in the extending direction, and the first return coupling liquid passage is located on the one side of the first supply coupling liquid passage in the extending direction. The head may be configured such that the first supply coupling liquid passage is located between the first return coupling liquid passage and the second return coupling liquid passage in the extending direction, and the second supply coupling liquid passage is located on the other side of the second return coupling liquid passage in the extending direction. The head may be configured such that the second supply coupling liquid passage is located between the first return coupling liquid passage and the second return coupling liquid passage in the extending direction, and the first supply coupling liquid passage is located on the one side of the first return coupling liquid passage in the extending direction. The first supply coupling liquid passage and the first return coupling liquid passage may be located on the same position in the extending direction and overlap each other in the orthogonal direction. Likewise, the second supply coupling liquid passage and the second return coupling liquid passage may be located on the same position in the extending direction and overlap each other in the orthogonal direction.

The number and positions of the supply openings and the return openings are not limited in particular. For example, in the third embodiment (FIG. 8), the head may be configured such that the supply openings 41*x*, 42*x* are located on the other side of the coupled portions of the respective supply liquid passages 31 in the arrangement direction, and the return openings 51*x*, 52*x* are located on the one side of the coupled portions of the respective return liquid passages 32 in the arrangement direction. In the third embodiment (FIG. 8), the head may be configured such that the supply opening 41*x* is located on the one side of the coupled portions of the respective supply liquid passages 31 in the arrangement direction, the return opening 51*x* is located on the one side of the coupled portions of the respective return liquid passages 32 in the arrangement direction, the supply opening 42*x* is located on the other side of the coupled portions of the respective supply liquid passages 31 in the arrangement direction, and the return opening 52*x* is located on the other side of the coupled portions of the respective return liquid passages 32 in the arrangement direction. The head may be configured such that each of the supply opening and the return opening is formed at the center of a corresponding one of the supply coupling liquid passage and the return coupling liquid passage (i.e., the center thereof in a direction in which the liquid passage extends).

A damper film may be provided on a surface of each of the coupling liquid passages, which surface communicates with the inlets of the respective supply liquid passages or the outlets of the respective return liquid passages.

At least one damper film may be provided between the first supply coupling liquid passage and the first return coupling liquid passage. At least one damper film may be provided between the second supply coupling liquid passage and the second return coupling liquid passage. In the case where a single damper film is provided between the liquid passages, pressure waves are canceled out between the liquid passages. In the case where two damper films separated from each other in the orthogonal direction are provided between the liquid passages, a space between the two damper films damps the pressure waves.

While a plurality of damper films separated from each other in the arrangement direction are provided on each of the coupling liquid passages in the above-described embodiments, the present disclosure is not limited to this configuration. For example, one or two damper films each elongated in the arrangement direction may be provided.

No damper film may be provided on each of the coupling liquid passages, the supply liquid passages, and the return liquid passages.

The positional relationship among the coupling liquid passages, the supply liquid passages, and the return liquid passages in the orthogonal direction is not limited in particular. For example, the supply coupling liquid passages and the return coupling liquid passages may be located at the same position in the orthogonal direction. The supply coupling liquid passages may be located below the return coupling liquid passages, in other words, the supply coupling liquid passages may be located on the other side of the return coupling liquid passages in the orthogonal direction. The supply liquid passages and the return liquid passages may be located at the same position in the orthogonal direction. The supply liquid passages may be located below the return liquid passages.

In the above-described embodiment (FIG. 2), the supply liquid passage 31 or the return liquid passage 32 formed between two of the rows of the individual passages 20 which are adjacent to each other in the arrangement direction communicates with the individual passages 20 belonging to the two rows. However, the present disclosure is not limited to this configuration. For example, a pair of the supply liquid passage 31 and the return liquid passage 32 may be formed for each row of the individual passages 20.

Each of the number of the supply liquid passages and the number of the return liquid passages at least needs to be two or more.

The individual passages need not be arranged in rows and may be arranged on a random basis.

The configuration of each of the individual passages (e.g., the shape of the pressure chamber and a manner of communication between the pressure chamber and the nozzle) is not limited in particular. For example, the pressure chamber may have any shape on the plane extending along the extending direction and the arrangement direction, such as a square, a parallelogram, a rhombus, a perfect circle, and an oval. While the pressure chamber is formed just above the nozzle in the above-described embodiments, the present disclosure is not limited to this configuration. For example, another liquid passage establishing communication between the pressure chamber and the nozzle may be formed. Each of the number of the nozzles and the number of the pressure chambers in each of the individual passages is not limited to one and may be two or more.

The positions of the inlet and the outlet in each of the individual passages are not limited in particular. For example, while the inlet 20*a* and the outlet 20*b* are arranged so as to be symmetric with respect to the center point O of the pressure chamber 22 in the above-described embodiment (FIG. 2), the inlet 20*a* and the outlet 20*b* may be arranged so as to be symmetric with respect to an axis extending in the extending direction through the center of the pressure chamber 22 in the arrangement direction. The inlet 20*a* and the outlet 20*b* may be located at the same position in the orthogonal direction. The inlet 20*a* may be located below the outlet 20*b*, in other words, the inlet 20*a* may be located on the other side of the outlet 20*b* in the orthogonal direction. In the above-described embodiment, the inflow passage 23 and the outflow passage 24 extend in the arrangement direction respectively from the two surfaces of the pressure chamber 22 which are opposed to each other in the arrangement direction. However, the inflow passage 23 and the outflow passage 24 may extend respectively from two surfaces of the pressure chamber 22 which are opposed to each other in the extending direction, then be bent or curved, and finally connected respectively to the supply liquid passage 31 and the return liquid passage 32. The inflow passage 23 and the outflow passage 24 may be located at the same position in the orthogonal direction. The inflow passage 23 may be located below the outflow passage 24.

The actuator is not limited to the piezoelectric actuator using piezoelectric elements and may be of any other type such as a thermal actuator using heating elements and an electrostatic actuator using an electrostatic force.

The head is not limited to the line head and may be a serial head which ejects liquid from nozzles onto a recording medium while moving in a scanning direction parallel with the widthwise direction of the sheet.

The recording medium is not limited to the sheet and may be any of a cloth, a circuit board, and the like.

The liquid ejected from the nozzles is not limited to the ink and may be any other type of liquid such as treatment liquid that coagulates or precipitates components of the ink.

The present disclosure is applied to the printer in the above-described embodiments but may be applied to a facsimile, a copying machine, and a multi-function peripheral (MFP), for example. The present disclosure may also be applied to a liquid ejection apparatus used for purposes different from image recording. For example, the present disclosure may be applied to a liquid ejection apparatus configured to eject conductive liquid onto a substrate to form a conductive pattern on the substrate.

What is claimed is:

1. A liquid ejection head, comprising:

a plurality of individual passages each comprising a nozzle;

a plurality of supply liquid passages each communicating with an individual inlet of a corresponding one of the plurality of individual passages;

a plurality of return liquid passages each communicating with an individual outlet of a corresponding one of the plurality of individual passages;

a first supply coupling liquid passage coupling the plurality of supply liquid passages to each other and communicating with a first inlet of each of the plurality of supply liquid passages; and a second supply coupling liquid passage coupling the plurality of supply liquid passages to each other and communicating with a second inlet of each of the plurality of supply liquid passages, wherein, in each of the plurality of supply liquid passages, the individual inlet of the corresponding one of the plurality of individual passages is located between the first inlet and the second inlet, wherein the plurality of individual passages comprise a first individual passage communicating with a first supply liquid passage of the plurality of supply liquid passages via the individual inlet and communicating with a first return liquid passage of the plurality of return liquid passages via the individual outlet, wherein the first supply liquid passage and the first return liquid passage extend in an extending direction and are arranged in an arrangement direction intersecting the extending direction, and wherein the first supply liquid passage and the first return liquid passage are located on opposite sides of the first individual passage in the arrangement direction such that the first supply liquid passage is located on one side of the first individual passage in the arrangement direction, and the first return liquid passage is located on the other side of the first individual passage in the arrangement direction.

2. The liquid ejection head according to claim 1, wherein the plurality of individual passages are arranged in the extending direction, and wherein the individual inlet of each of the plurality of individual passages is located between the first supply coupling liquid passage and the second supply coupling liquid passage in the extending direction.

3. The liquid ejection head according to claim 1, wherein at least a portion of each of the plurality of supply liquid passages and the plurality of return liquid passages is defined by a damper film.

4. A liquid ejection head, comprising:

a plurality of individual passages each comprising a nozzle;

a plurality of supply liquid passages each communicating with an individual inlet of a corresponding one of the plurality of individual passages;

a plurality of return liquid passages each communicating with an individual outlet of a corresponding one of the plurality of individual passages;

a first supply coupling liquid passage coupling the plurality of supply liquid passages to each other and communicating with a first inlet of each of the plurality of supply liquid passages;

a second supply coupling liquid passage coupling the plurality of supply liquid passages to each other and communicating with a second inlet of each of the plurality of supply liquid passages, a first return coupling liquid passage coupling the plurality of return liquid passages to each other and communicating with a first outlet of each of the plurality of return liquid passages; and a second return coupling liquid passage coupling the plurality of return liquid passages to each other and communicating with a second outlet of each of the plurality of return liquid passages, wherein, in each of the plurality of supply liquid passages, the individual inlet of the corresponding one of the plurality of individual passages is located between the first inlet and the second inlet, and wherein, in each of the plurality of return liquid passages, the individual outlet of each of the plurality of individual passages is located between the first outlet and the second outlet.

5. The liquid ejection head according to claim 4, wherein each of the first supply coupling liquid passage and the second supply coupling liquid passage communicates with a liquid storage chamber via two supply openings formed such that coupled portions of the plurality of supply liquid passages are interposed between the two supply openings.

6. The liquid ejection head according to claim 4, wherein each of the first return coupling liquid passage and the second return coupling liquid passage communicates with a liquid storage chamber via two supply openings formed such that coupled portions of the plurality of return liquid passages are interposed between the two supply openings.

7. The liquid ejection head according to claim 4, wherein the plurality of supply liquid passages and the plurality of return liquid passages extend in an extending direction and are arranged in an arrangement direction intersecting the extending direction, wherein the first supply coupling liquid passage and the first return coupling liquid passage extend in the arrangement direction and are located on one side of the plurality of supply liquid passages and the plurality of return liquid passages in the extending direction, and wherein the second supply coupling liquid passage and the second return coupling liquid passage extend in the arrangement direction and are located on the other side of the plurality of supply liquid passages and the plurality of return liquid passages in the extending direction.

8. The liquid ejection head according to claim 7, wherein the first supply coupling liquid passage and the first return coupling liquid passage are located respectively at different positions in the extending direction, and wherein the second supply coupling liquid passage and the second return coupling liquid passage are located respectively at different positions in the extending direction.

9. The liquid ejection head according to claim 8, wherein the first return coupling liquid passage and the second return coupling liquid passage are located between the first supply coupling liquid passage and the second supply coupling liquid passage in the extending direction.

10. The liquid ejection head according to claim 8, wherein the first supply coupling liquid passage and the second supply coupling liquid passage are located between the first return coupling liquid passage and the second return coupling liquid passage in the extending direction.

11. The liquid ejection head according to claim 7, wherein each of the first supply coupling liquid passage and the second supply coupling liquid passage communicates with a liquid storage chamber via a supply opening formed on one side of coupled portions of the plurality of supply liquid passages in the arrangement direction, and wherein each of the first return coupling liquid passage and the second return coupling liquid passage communicates with the liquid storage chamber via a return opening formed on the one side of coupled portions of the plurality of return liquid passages in the arrangement direction.

12. The liquid ejection head according to claim 7, wherein at least a portion of each of the first supply coupling liquid passage and the second supply coupling liquid passage is defined by a damper film.

13. The liquid ejection head according to claim 12, wherein at least a portion of each of the first return coupling liquid passage and the second return coupling liquid passage is defined by a damper film.

14. The liquid ejection head according to claim 13, wherein the first supply coupling liquid passage communicates with the first inlet of each of the plurality of supply liquid passages at one of opposite surfaces of the first supply coupling liquid passage, which one is located on the other side of the other of the opposite surfaces of the first supply coupling liquid passage in the extending direction, wherein the second supply coupling liquid passage communicates with the second inlet of each of the plurality of supply liquid passages at one of opposite surfaces of the second supply coupling liquid passage, which one is located on the one side of the other of the opposite surfaces of the second supply coupling liquid passage in the extending direction, wherein the first return coupling liquid passage communicates with the first outlet of each of the plurality of return liquid passages at one of opposite surfaces of the first return coupling liquid passage, which one is located on the other side of the other of the opposite surfaces of the first return coupling liquid passage in the extending direction, wherein the second return coupling liquid passage communicates with the second outlet of each of the plurality of return liquid passages at one of opposite surfaces of the second return coupling liquid passage, which one is located on the one side of the other of the opposite surfaces of the second return coupling liquid passage in the extending direction, and wherein the damper film is provided on each of the first supply coupling liquid passage, the second supply coupling liquid passage, the first return coupling liquid passage, and the second return coupling liquid passage, at a surface different from the opposite surfaces in the extending direction.

15. The liquid ejection head according to claim 13, wherein the first supply coupling liquid passage is located on one side of the first return coupling liquid passage in an orthogonal direction orthogonal to each of the extending direction and the arrangement direction, wherein the damper film provided on the first supply coupling liquid passage is located on the one side of the first supply coupling liquid passage in the orthogonal direction, and wherein the damper film provided on the first return coupling liquid passage is located on the other side of the first return coupling liquid passage in the orthogonal direction.

16. The liquid ejection head according to claim 13, wherein the second supply coupling liquid passage is located on one side of the second return coupling liquid passage in an orthogonal direction orthogonal to each of the extending direction and the arrangement direction, wherein the damper film provided on the second supply coupling liquid passage is located on one side of the second supply coupling liquid passage in the orthogonal direction, and wherein the damper film provided on the second return coupling liquid passage is located on the other side of the second return coupling liquid passage in the orthogonal direction.

17. The liquid ejection head according to claim 13, wherein a plurality of damper films each as the damper film which are spaced apart from each other in the arrangement direction are provided on each of the first supply coupling liquid passage, the second supply coupling liquid passage, the first return coupling liquid passage, and the second return coupling liquid passage.

* * * * *